US008413461B2

(12) United States Patent
Yanik et al.

(10) Patent No.: US 8,413,461 B2
(45) Date of Patent: Apr. 9, 2013

(54) AUXILIARY COOLING SYSTEM

(75) Inventors: Mustafa Kemal Yanik, York, PA (US); Mahesh Valiya Naduvath, Cockeysville, MD (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 12/670,276

(22) PCT Filed: Jul. 17, 2008

(86) PCT No.: PCT/US2008/070306

§ 371 (c)(1), (2), (4) Date: Jan. 22, 2010

(87) PCT Pub. No.: WO2009/014983

PCT Pub. Date: Jan. 29, 2009

(65) Prior Publication Data

US 2010/0199714 A1 Aug. 12, 2010

Related U.S. Application Data

(60) Provisional application No. 60/951,599, filed on Jul. 24, 2007.

(51) Int. Cl.
*F25B 39/04* (2006.01)

(52) U.S. Cl. ..... 62/507; 62/513

(58) Field of Classification Search ..... 62/507, 62/506, 513, 512, 526, 428; 165/104.34, 165/184

See application file for complete search history.

(56) References Cited

U.S. PATENT DOCUMENTS

| | | | | | |
|---|---|---|---|---|---|
| 4,063,431 | A * | 12/1977 | Dankowski | 62/239 |
| 4,104,890 | A * | 8/1978 | Iwasaki | 62/324.1 |
| 4,171,622 | A * | 10/1979 | Yamaguchi et al. | 62/160 |
| 4,190,105 | A | 2/1980 | Dankowski | |
| 4,799,538 | A * | 1/1989 | Dagard et al. | 165/47 |
| 5,813,249 | A * | 9/1998 | Matsuo et al. | 62/509 |
| 5,875,650 | A * | 3/1999 | Nobuta et al. | 62/509 |
| 5,992,160 | A * | 11/1999 | Bussjager et al. | 62/79 |
| 6,182,744 | B1 * | 2/2001 | Nakamura et al. | 165/140 |
| 6,209,348 | B1 * | 4/2001 | Shinmura et al. | 62/509 |
| 6,397,627 | B1 * | 6/2002 | Aki et al. | 62/509 |
| 6,427,480 | B1 * | 8/2002 | Ito et al. | 62/509 |
| 2001/0027663 | A1 * | 10/2001 | Zeigler et al. | 62/406 |
| 2002/0023448 | A1 * | 2/2002 | Ito et al. | 62/222 |
| 2003/0061822 | A1 * | 4/2003 | Rafalovich | 62/92 |
| 2005/0155375 | A1 * | 7/2005 | Wensink et al. | 62/510 |
| 2005/0198986 | A1 * | 9/2005 | Allen | 62/244 |

(Continued)

FOREIGN PATENT DOCUMENTS

| | | | |
|---|---|---|---|
| CN | 1942724 | A | 4/2007 |
| WO | 2005100881 | A1 | 10/2005 |

*Primary Examiner* — Mohammad Ali

(74) *Attorney, Agent, or Firm* — McNees Wallace & Nurick LLC

(57) ABSTRACT

Air cooled chillers having a condenser section (300) sized to match chiller capacity and auxiliary cooling requirements satisfied by use of an independent cooling coil (314) dedicated to providing auxiliary cooling. The independent cooling coil (314) is located within the current condenser (300), but utilizes available space within the existing condenser, as well as a small portion of the airflow driven by the existing condenser fan (320). Thus, the auxiliary cooling capacity is provided with a single dedicated coil design, but which otherwise uses existing equipment and space.

20 Claims, 11 Drawing Sheets

U.S. PATENT DOCUMENTS

2005/0223730 A1 10/2005 Kester et al.
2006/0116036 A1* 6/2006 Sundel ..... 440/89 R
2006/0117781 A1* 6/2006 Moffitt ..... 62/271
2007/0108934 A1* 5/2007 Smith et al. ..... 318/701

* cited by examiner

AUXILIARY COOLING SYSTEM

CROSS-REFERENCES TO RELATED PATENT APPLICATIONS

This application claims the benefit of U.S. Provisional Application No. 60/951,599, entitled EFFECTIVE AUXILIARY COOLING SYSTEM FOR MODULAR AIR-COOLED CHILLERS, filed Jul. 24, 2007, which is hereby incorporated by reference.

BACKGROUND

The application generally relates to auxiliary cooling systems used with air-cooled condensers located outside of the building being cooled to provide auxiliary cooling for specialized heat generating functions not adequately served by the air conditioning system.

Certain components in cooling systems that are not in the conditioned space also require cooling. For example, electrical components associated with the electronic controls of a heating, ventilation and air conditioning system may generate significant heat as a result of operations. These components are usually housed in a separate enclosure or cabinet that isolates the components from the atmosphere. However, the enclosure is generally weatherproof with minimal ventilation, so a substantial buildup of heat also occurs in the enclosure or cabinet as power electronic semiconductor components in the cabinet generate a large amount of heat during operation. It is necessary to remove this heat in order to avoid a rise in temperatures that could either destroy the electronic semiconductor components or threaten proper operation of the electronic semiconductor components. The process of removing heat from such auxiliary components is referred to as auxiliary cooling. Auxiliary cooling is also utilized in certain vapor compression systems that utilize an oil separator installed at the outlet of the compressor to separate refrigerant and oil. The oil is returned from the oil separator to the compressor. In certain applications, the temperature of the oil leaving the oil separator is sufficiently elevated that cooling is required before it is returned to the compressor for proper operation of the system. Cooling of the oil also is provided by an auxiliary cooling system.

For cooling systems utilizing air-cooled condensers located outside of the building, such as on a rooftop, auxiliary cooling conveniently may be provided by ambient air. However, auxiliary cooling may be provided by refrigerant or chilled water. In these designs, excess heat is transferred from an enclosure by means of a heat transfer device, such as a heat transfer device, and depending on the design, directly from the electronic components to the heat transfer device, the heat transfer device comprising a material having high thermal conductivity, the heat transfer device further including cooling channels that constitute a portion of the heat transfer loop that circulates a fluid to remove heat from the cabinet and from the electrical components. The fluid contacting the heat transfer device removes thermal energy from the heat transfer device. This heat then must be removed from the flowing fluid.

An effective apparatus and method for providing auxiliary cooling without adversely affecting the cooling efficiency of the condenser is a much sought-after improvement. Furthermore, such an apparatus and method desirably provide auxiliary cooling within existing mechanical footprints at low cost. Intended advantages of the systems and/or methods set forth herein satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

Air-cooled condensers are common in commercial cooling systems and may utilize an air-cooled condenser as an outdoor unit. The condenser section is sized to match cooling capacity of the system. Cooling is provided by a vapor compression system utilizing a compressor appropriately sized for the area to be cooled. Hot high pressure vapor from a compressor discharge line is cycled to the condenser positioned in the outdoor unit where it is cooled, condensed and cycled back to the compressor. An auxiliary circuit includes an independent cooling coil located in the outdoor unit combined with the condenser cooling coil. The auxiliary circuit further includes a heat transfer device in communication with a region requiring cooling, and a heat transfer loop that circulates a fluid from the chill plate, which absorbs heat from the region and transfers it to the fluid, to the independent cooling coil, where heat is removed from the fluid in the outdoor unit The outdoor unit includes an air-cooled condenser that comprises a first coil forming a portion of a first loop for circulating a first fluid, a second coil forming a portion of a second loop for circulating a second fluid wherein the first loop is adapted for connection to a compressor and a compressor discharge line for circulating the first fluid as hot high pressure vapor from the compressor to the first coil, and wherein the second loop includes a chill plate, and is adapted for connection to the chill plate for circulating hot fluid from the chill plate to the second coil.

Alternative exemplary embodiments relate to other features and combinations of features as may be generally recited hereinafter.

DETAILED DESCRIPTION OF THE EXEMPLARY EMBODIMENTS

The present invention utilizes an independent cooling coil located within the current condenser, but uses available space within the existing condenser, as well as the airflow driven by an existing condenser fan. Thus, the auxiliary cooling capacity of the present invention is provided with a dedicated coil design independent of the condenser loop, but which otherwise uses existing equipment and space. Auxiliary cooling provided in this manner provides the advantage of being added in a relatively simple manner. Since the additional auxiliary cooling is provided within the framework of existing condensers, requiring simple modification of existing condensers and not the redesign of existing condensers to accommodate a dedicated auxiliary cooling system. Another advantage of this dedicated independent coil design is that while it is positioned within the existing condenser package and makes use of existing fans, it does not decrease the condenser efficiency. It thus becomes a cost-effective solution that also does not substantially decrease condenser performance.

Figure 1:
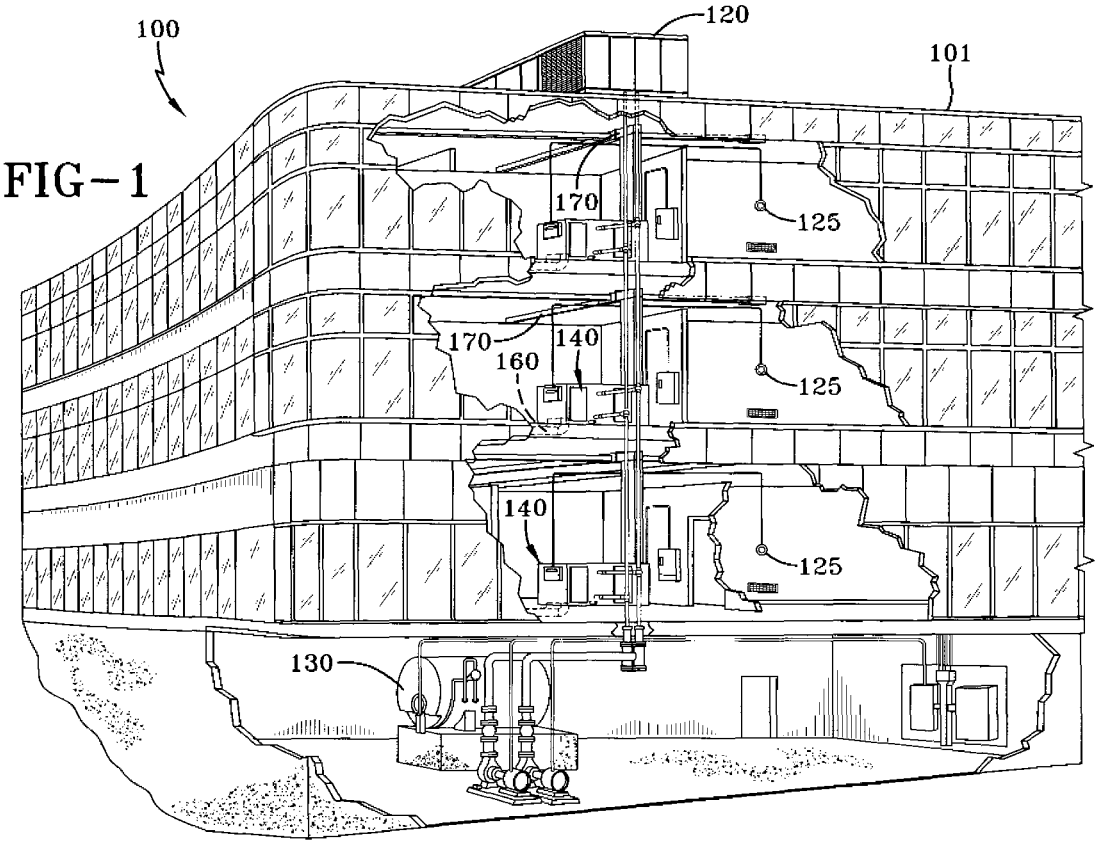
FIG. 1 depicts a building having a cooling system utilizing a condenser located in an outdoor unit on the rooftop.

FIG. 1 depicts a building 100 having a cooling system utilizing a condenser housed in an outdoor unit 120 positioned on the rooftop 101 of building 100. In this building, the cooling system is provided by individual cooling and air handling systems. Aor handling system 140 delivers conditioned air via supply and return ductwork 160, 170. Heating and cooling is regulated by a temperature measuring device 125, such as a thermostat located on each floor. Heating is centralized in a boiler 130 located in the basement of the building connected to the air handling systems on each floor. The individual cooling systems on each floor are connected to a condenser located in outdoor unit 120 that is positioned on rooftop 101 of building 100.

Figure 2A:
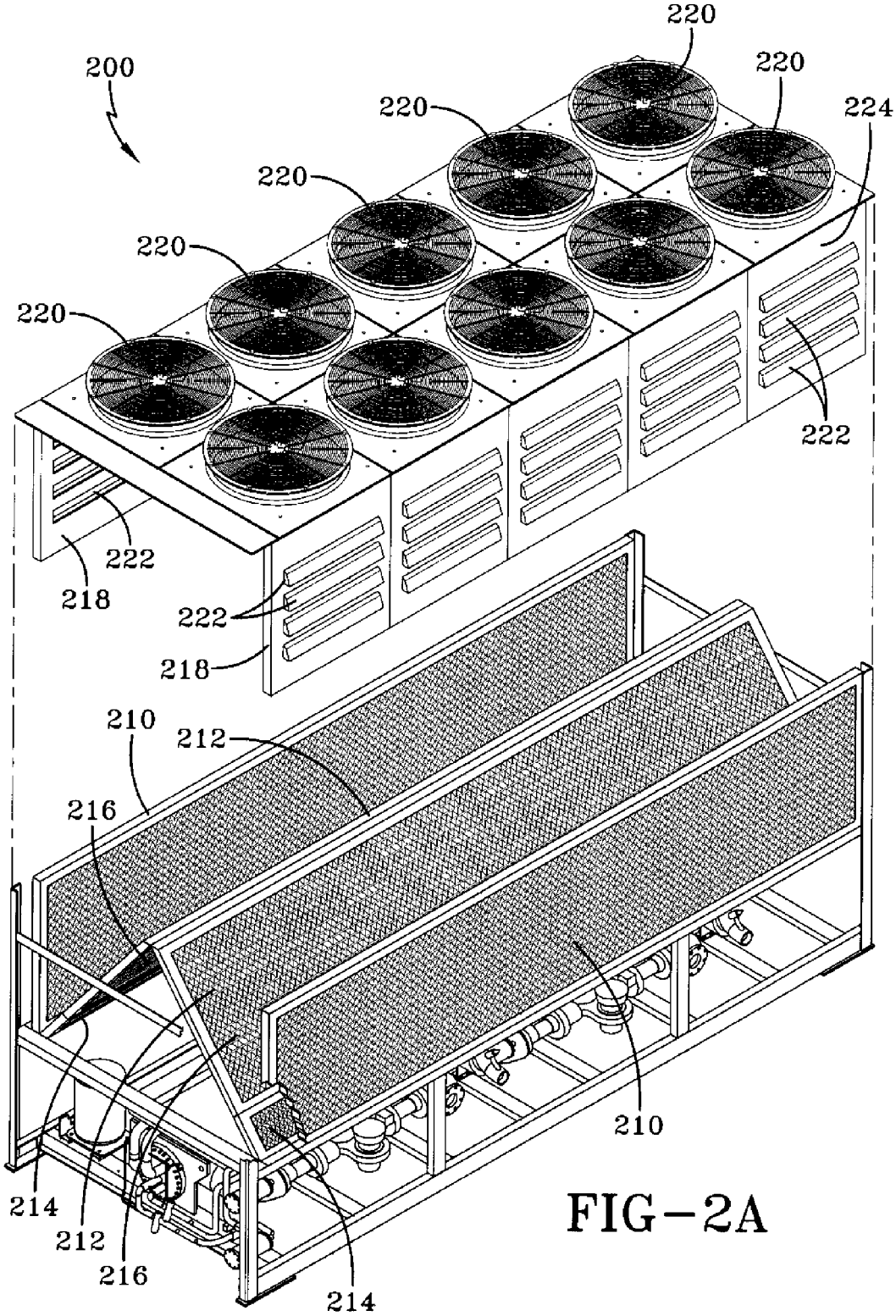
FIG. 2 depicts a front view and side view of an embodiment of a prior art condenser utilizing a condenser having condenser coils arranged in a W configuration, a portion of the lower coils being used for auxiliary cooling.
Figure 2B:
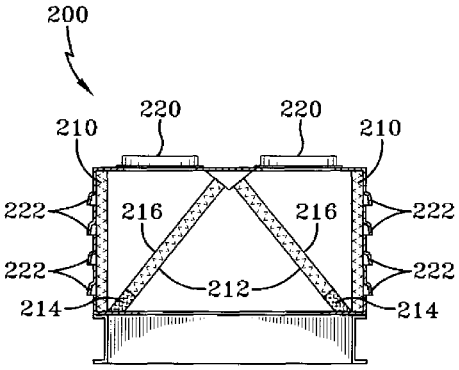
Figure 2C:
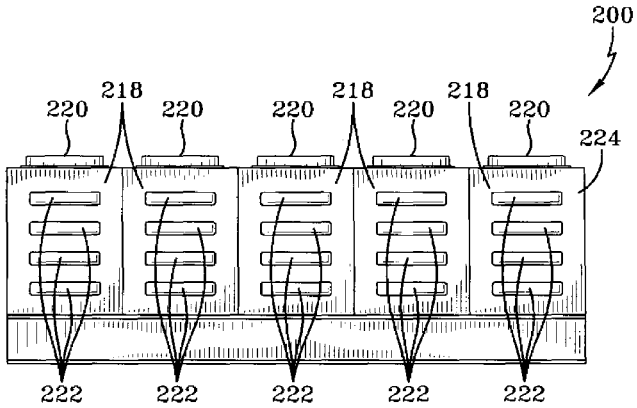

FIG. 2*a* is an exploded perspective view of the outdoor unit 120 of FIG. 1, which includes condenser 200. Condenser 200 includes coils generally arranged in a W configuration. FIG. 2*b* is a front view and FIG. 2*c* is a side view of prior art condenser 200 of FIG. 2*a*. The condenser utilizes four condenser coils arranged in a W configuration. Two outer coils 210 are arranged in a substantially vertical orientation, while inner coils 212 are arranged in a substantially inclined orientation. A portion 214 of inclined inner coils is utilized for auxiliary cooling. While any portion of inner coils 212 can be used to provide the auxiliary cooling, the bottom of inner coils 212 is usually used for the auxiliary cooling. The front view, FIG. 2*b*, depicts cooling coils 210, 212 with the W configuration. The cooling coils include an upper circuit 216 dedicated to condenser cooling and a bottom, shaded circuit, portion 214, dedicated to auxiliary cooling. The cooling coils are not evident in the side view, FIG. 2*b* the view of the coils blocked by panels 218 forming cabinets 224 and are better viewed in FIG. 2*a*. The auxiliary cooling circuit, portion 214, is not an independent coil, but rather is a separate circuit in coil 212. As shown, the length of condenser coils 210, 212 varies in proportion to unit capacity and number of fans 220, and the length of the auxiliary cooling circuit, portion 214, also varies in a similar manner. Fans 220 draw cooling air in through louvers 222 or openings on panels 218 on sides of cabinets 224 that house cooling coils 210,212. Air drawn in by fans 220 over coils 210, 212 is used as a heat exchange fluid to remove heat from the fluid in the coils and reduce the temperature of the fluid in the coils. Thus, air drawn in by existing fans 220 exchanges heat from the fluid in the auxiliary cooling circuits which form lower portion 214 of inner coil as well as in condenser circuits 210, 216. It will be understood that the size of condenser 200 is matched to unit capacity by varying the size of cooling coils 210, 212 in condenser 200, and larger or smaller condensers may be used depending upon the unit capacity. It will also be understood that auxiliary cooling circuits 214 can be positioned in any of the condenser coils, and that the length of the condenser circuits 210, 216 can be varied to provide more or less capacity.

Figure 3A:
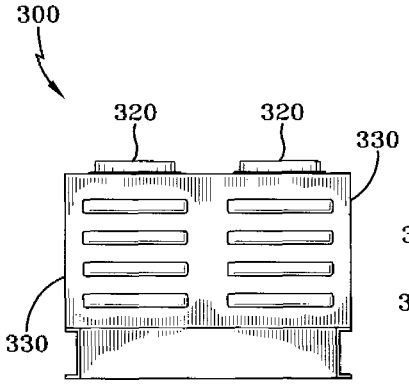
FIG. 3 depicts a front and side view of second embodiment of a condenser showing an auxiliary cooling coil positioned within a modular V-shaped condenser coil.
Figure 3B:
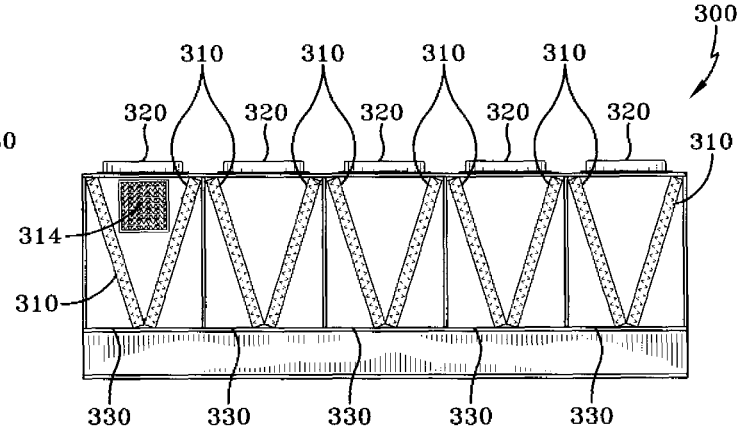

FIG. 3 depicts the present invention an alternate embodiment of the placement of an auxiliary cooling coil 314 within condenser 300. FIG. 3 depicts a front view and a side view of a condenser having cooling coils 310 with a V-shaped configuration. The cooling coils are arranged in a slab. The V-shaped configuration in FIG. 3*b* results from a pair of slabs being arranged in a V-shaped geometry. The coil configuration provides a modular design. In the embodiment shown, the length of cooling coils 310 does not change. Instead, coils 310 are added or removed as additional V-sections in proportion to unit capacity. In the configuration shown, condenser coil 310 and the auxiliary coil 314 are independent structurally, but share the same fan 320 that drives airflow through both. Only the first condenser cooling coil 310 is evident in the front view, the remainder of the condenser cooling coils 310 being positioned behind the first condenser cooling coil. Independent auxiliary cooling coil 314 is nested within the V-shaped geometry formed by condenser cooling coils 310. The independent cooling coil is located within the current condenser, but utilizes available space within the existing condenser, as well as the airflow driven by an existing condenser fan. Thus, the auxiliary cooling capacity is provided with a single dedicated coil design, but which otherwise uses existing equipment and space. In FIG. 3*b*, condenser 300 is subdivided into a plurality of sections 330, each section 330 including a cooling coil having a V-shaped geometry, with fans 320 located over each of section 330 to draw ambient air over the coils to provide heat exchange. Sections 330 can be provided as part of a modular design, allowing an increase or decrease in cooling capacity by adding or removing sections 330 of the modular design. Auxiliary cooling coils 314 also can be varied in capacity by modifying their size and/or their number. The geometry of the cooling coils can also be varied as desired, the configuration of the coils not being restricted to a V-shaped geometry. FIG. 3*b* depicts a condenser having a single auxiliary cooling coil 314, it being understood that each section 330 may include a nested auxiliary cooling coil.

Figure 4A:
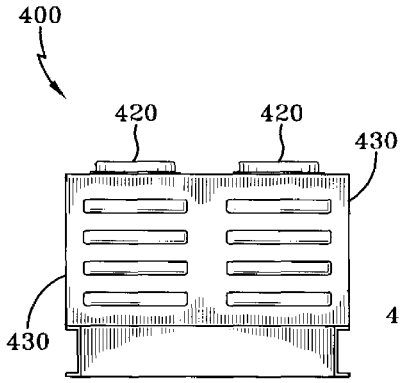
FIG. 4 depicts a side view of an embodiment of a condenser showing auxiliary cooling coils positioned at the bottom of a V-shaped condenser coil.
Figure 4B:
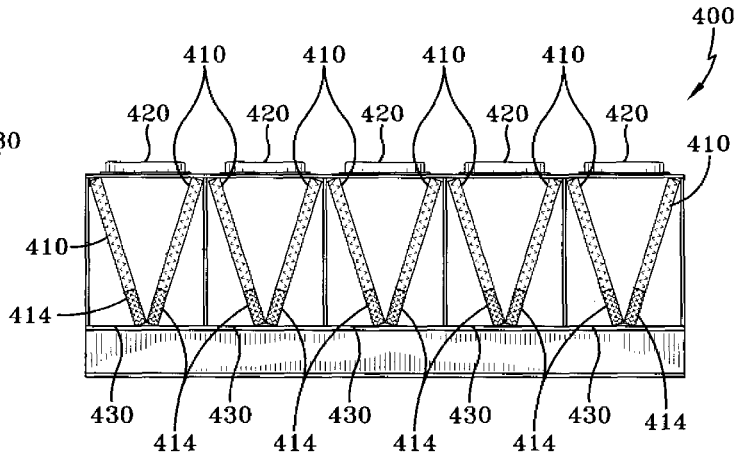

FIG. 4 is a side view of a variation of a condenser 400 depicted in FIG. 3. Cooling coils 410 are arranged sectionally in a modular V-shaped configuration, and each modular V-shaped section includes cooling coils 414 of an independent auxiliary cooling circuit adjacent to the condenser cooling coils 410. Cooling coils 414 of the auxiliary cooling circuit are positioned along the base of the V of the V-shaped configuration, with cooling coils 410 of the condenser circuit arranged along the upper legs of the V and over cooling coils 414 of the auxiliary cooling circuit. Cooling coils 414 of the auxiliary cooling circuits can be connected in series to provide additional auxiliary cooling as additional sections 430 are added. Alternatively, the auxiliary cooling circuits can be connected independent of one another, with each of the auxiliary cooling circuits being used to withdraw heat from different regions experiencing a heat build-up, but each requiring the use of auxiliary cooling to remove heat. The auxiliary cooling capacity also can be increased or decreased as needed by connecting or disconnecting the auxiliary cooling circuits. Interestingly, as noted, the auxiliary cooling capacity optionally can be connected in series as needed, or can be channeled to provide dedicated auxiliary cooling to various components, such as a circuit for oil cooling and a circuit for cooling of variable speed drive (VSD) controls that include temperature sensitive electronics and electrical components. If all of the auxiliary cooling provided is not needed, auxiliary circuits beyond what is required can be left unconnected so that no cooling fluid passes through them. The operation of cooling fans 420 in each of the sections draws ambient air used as a heat exchange fluid simultaneously over both auxiliary cooling coils 414 and the condenser cooling coils 410. While the position of cooling coils 414 of the auxiliary cooling circuit may be at the base of the V-geometry, as shown, cooling coils 414 of the auxiliary cooling circuit may be positioned anywhere along the V-geometry, and condenser cooling coils 410 are independent of cooling coils 414 of the auxiliary circuit, as the condenser circuit is independent of any auxiliary circuits. The embodiment shown utilizes a single V-shaped configuration and simplifies design and manufacturing.

Figure 5A:
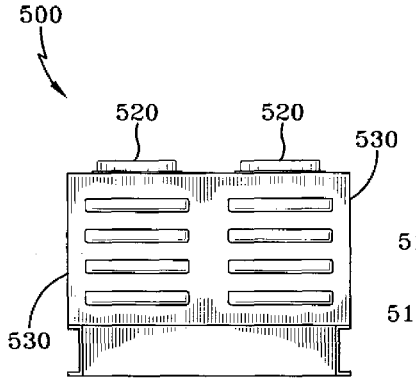
FIG. 5 depicts a side view of an embodiment of a condenser showing an expanded cooling coil positioned within a V-shaped condenser coil.
Figure 5B:
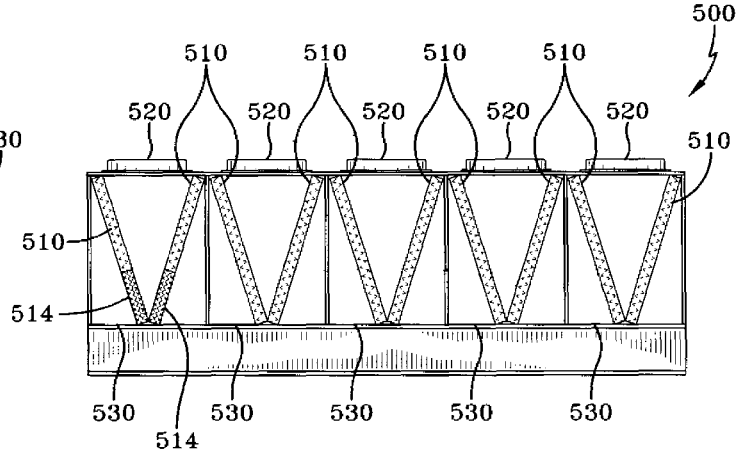

FIG. 5 is a variation of FIG. 4. The side view of FIG. 5 clearly shows that coils 514 of auxiliary cooling circuit are located in a single section of the condenser 500. In FIG. 5, coils 514 of the auxiliary cooling circuit are located in the forward section of condenser 500, although coils 514 of auxiliary cooling circuit are not restricted to a single location. The embodiment of FIG. 5 shown differs from the previous embodiment in that additional auxiliary cooling is provided by modifying the size of cooling coils 514 of the auxiliary cooling circuit in the V-portion of a section. Once again, it will be understood by those skilled in the art that while coils 514 of the auxiliary cooling circuit can be located in any of the sections of condenser 500 when condenser 500 includes more than one section 530, and the size or length of coils 514 of the auxiliary cooling circuit will vary depending upon the auxiliary cooling requirements of the system. In the embodiment shown, the overall manufacturing is complicated by the fact that at least two different modular components are provided, one with coils 514 for an auxiliary cooling circuit, and one or more without coils for an auxiliary cooling circuit. Furthermore, modular components forming sections 530 with different sized cooling coils 514 for the auxiliary cooling circuits may be required, depending on the required auxiliary cooling capacity.

Figure 6A:
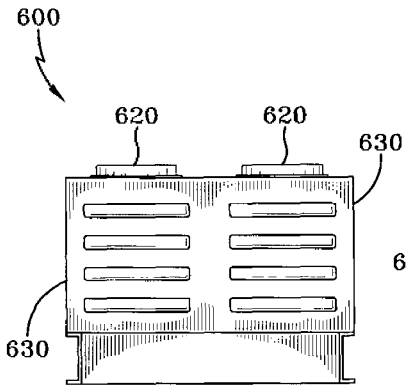
FIG. 6 depicts a side view of an embodiment of a condenser showing a horizontal auxiliary cooling system in the condenser cabinet.
Figure 6B:
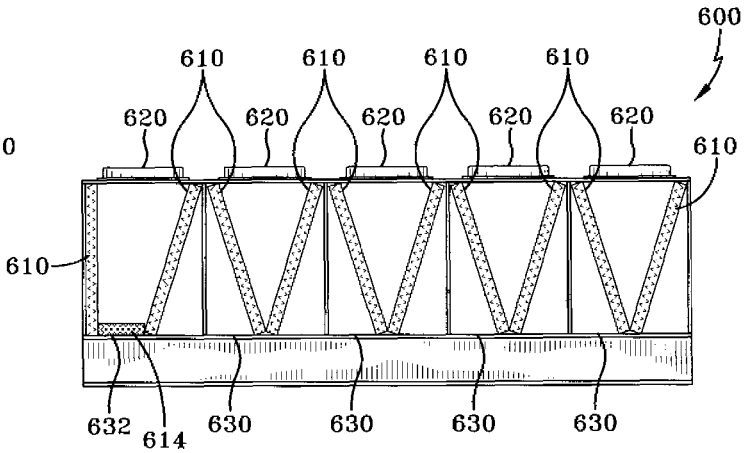

FIG. 6 provides a side view of an alternate embodiment of condenser 600 having an auxiliary cooling coil. In the embodiment shown, condenser 600 has a modular design that includes a plurality of V-shaped coils 610 in the condenser circuit. Cooling coil 614 of the auxiliary cooling circuit is an independent coil, which is positioned adjacent to the V-shaped cooling coils 610, coils 614 shown in a substantially horizontal position. The position of cooling coil 614 of auxiliary circuit is not limited to a substantially horizontal position, and may assume any angular position with respect to the V-shaped coil. Also, the geometry of cooling coil 614 of auxiliary cooling circuit may vary so that coil 610 may assume any shape. The embodiment shown, like previous embodiments, also does not require a separate cooling fan for auxiliary cooling coil 614, but utilizes existing condenser cooling fans 620 as the source of cooling fluid for heat exchange. When condenser 600 includes a plurality of sections 630, auxiliary cooling coil 614 can be positioned adjacent and within the V geometry of any of coils 610. In the embodiment shown, condenser 600 includes a plurality of sections 630, but the section, here section 632 that houses auxiliary cooling coil 614 has a condenser cooling coil 610 that has a slightly different geometry than other V-coils in the condenser 600. In the embodiment shown, coils 614 of the auxiliary cooling circuit may be positioned substantially horizontally, within coils 610 of the first or last of arranged sections 632.

Figure 7A:
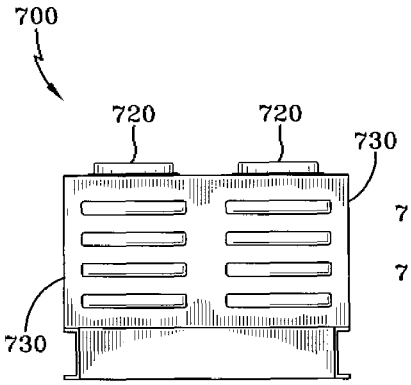
FIG. 7 depicts a side view of an embodiment of a condenser showing a V-shaped auxiliary cooling coil nested in a V-shaped condenser coil.
Figure 7B:
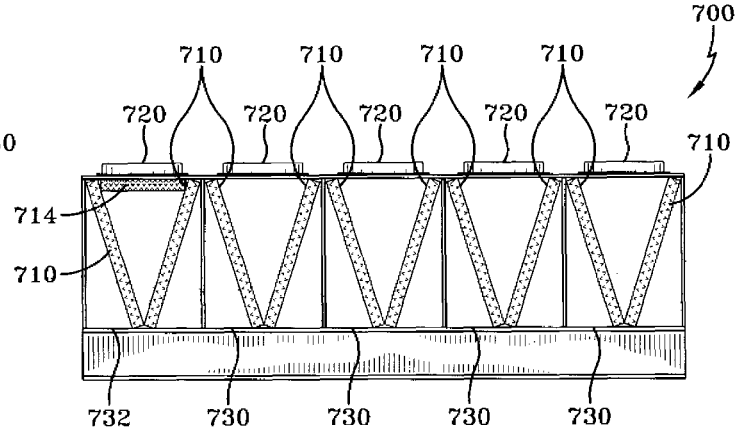

FIG. 7 depicts a side view of an alternate embodiment of the auxiliary cooling system of the present invention. Condenser 700 includes a plurality of sections 730, each section including condenser cooling coils 710, and a fan 720. One section further includes auxiliary cooling coils 714. Condenser cooling coils 710 and auxiliary cooling coils 714 are independent of each other. Condenser cooling coils 710 are arranged as discussed tohave a substantially V-shaped geometry, when viewed from the side. As depicted, auxiliary cooling coil 714 may be nested with respect to condenser cooling coils 710. The geometry of auxiliary cooling coil 714 is such that it can nest within the substantially V-shaped geometry of condenser cooling coils 710. Nesting may require a modification or variation of the geometry of condenser coils 710 when housed with auxiliary cooling coils 714 such as shown in section 732. The auxiliary cooling coils 714 may be of any geometry that nests within the geometry of condenser cooling coils 710 while allowing cooling air to be circulated over both condenser cooling coils 710 and the auxiliary cooling coil 714. The embodiment shown also permits auxiliary coil 714 to take advantage of the cooling provided by existing fan(s) 720, but does require design and incorporation into condenser 700 of a separate fan for auxiliary cooling coil 714. Although auxiliary cooling coil 714 is depicted in a nested position of condenser cooling coil 710 and located in the forward section of condenser 700, it will be understood by those skilled in the art that auxiliary coil 714 can be located in any section 730 and nested in any of condenser cooling coils 710 when condenser 700 includes a plurality of sections 730, 732. Furthermore, auxiliary cooling capacity can be varied by changing the size of auxiliary cooling coil 714 or by changing the number of auxiliary cooling coils 714.

Figure 8:
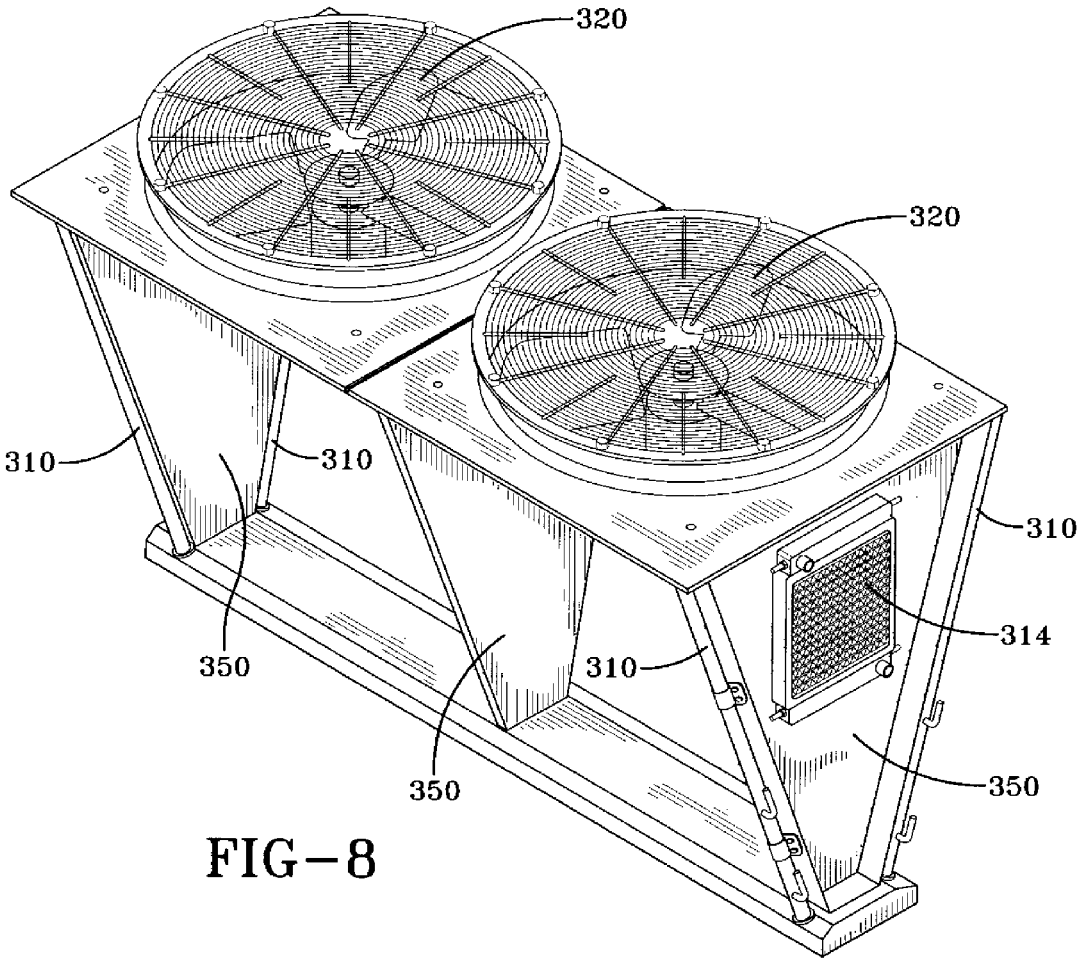
FIG. 8 is a more detailed view of FIG. 3B, depicting an auxiliary cooling coil mounted adjacent the condenser coils and panel, and below the condenser fan.
Figure 10:
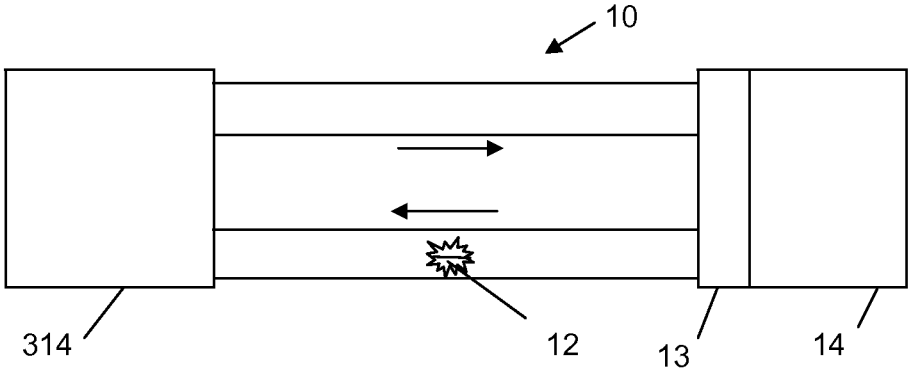
FIG. 10 schematically shows an embodiment of an auxiliary cooling circuit.

Referring again to FIG. 3, cooling coil 314 of the auxiliary cooling circuit 10 (see FIG. 10) is within the V formed by condenser cooling coils 310. A V-shaped panel spans the space between each of the legs (forming the V) of condenser coils 310 as shown in FIG. 8. As shown, V panel is a sheet metal structure installed to prevent air from bypassing condenser coils 310. Heated cooling fluid 12 from a heat transfer device 13 associated with the section of the cooling system that requires auxiliary cooling, e.g., a variable speed drive with electrical components, 14 or with an area of building 100 that requires cooling 14 is circulated through an auxiliary cooling circuit 10, as shown in FIG. 10, that includes auxiliary cooling coils 314. Air drawn by fans 320 through the cabinet passes cooling air over both condenser coils 310 and auxiliary coil 314 of the auxiliary cooling circuit 10, removing heat from the coils. The cooling fluid 12 passing through coils 314 of the auxiliary cooling circuit 10, after having heat removed, may then be circulated through auxiliary cooling coils 314, back to the area that requires auxiliary cooling 14. The cooling fluid 12 can be any fluid, and may include oil, water, or water treated with glycol or similar additive that serves as a freezing point depressant to lower the freezing point of water.

Figure 9:
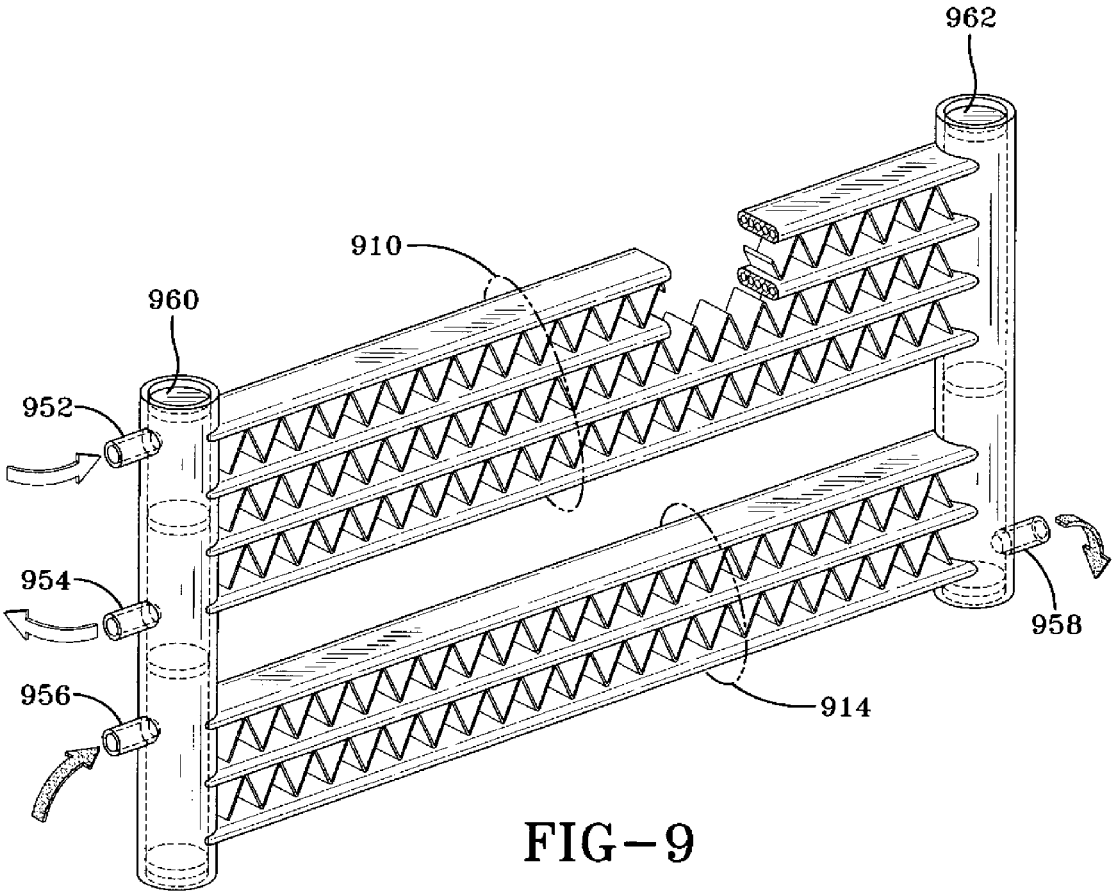
FIG. 9 depicts the independent flow of condenser fluid (refrigerant) and auxiliary fluid in separate condenser loops.

FIG. 9 depicts an arrangement of condenser coil 910 and auxiliary cooling coil 914 in another variation of the present invention. The prior embodiments depict two independent coils, one for refrigerant condensation and the other for auxiliary cooling. Such embodiments are readily implemented for round tube flat plate fin coils. The embodiment in FIG. 9 is particularly suited for creating independent circuits in multichannel tube or coil, one for condensation of refrigerant and the other for oil cooling. The condenser coil is part of a first circuit that circulates a first fluid, a refrigerant fluid, and the auxiliary cooling coil is part of a second circuit that circulates a second fluid. FIG. 9 does not show the coils arranged in a cabinet with a fan, which have been omitted for better clarity. The auxiliary cooling coil is positioned below the condenser coil. However, the condenser coil position is not so limited, as the circuit may be positioned in any part of the coil. In FIG. 9, the two coils are adjacent to one another, but the circuits are independent of one another, the fluids from the circuits entering common manifolds to permit ingress and egress of fluids, the circuits being separated from one another in the manifolds by dam/baffles. Hot refrigerant enters condenser cooling coil 910 at a top inlet 952 formed in a manifold 960, and channels through the condenser coil, exiting the coil from an outlet 954 formed in manifold 960 below the inlet as a cooled refrigerant. Auxiliary cooling fluid, which may be oil or glycol, but is not so limited, enters auxiliary cooling coil 914 at an inlet 956 formed in manifold 960, and circulates through auxiliary coil 914 and exits at an outlet 958 formed in a manifold 962. The refrigerant and cooling fluids do not mix in manifolds 960, 962. A single manifold 960 may be utilized if desired, in which case the second fluid would enter and exit at outlet 958 located in manifold 960. Air, drawn by a fan (not shown), passes over the coils, removing heat by convection. Thus, the present invention provides auxiliary cooling capacity for a cooling system while utilizing the existing equipment and space of the condenser, minimizing the expense. The system further provides arrangements to increase the auxiliary cooling capacity, as needed, or to provide independent auxiliary cooling to various areas that require independent cooling.

It should be understood that the application is not limited to the details or methodology set forth in the description or illustrated in the figures. It should also be understood that the phraseology and terminology employed herein is for the purpose of description only and should not be regarded as limiting.

While the exemplary embodiments illustrated in the figures and described are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. In a cooling system wherein cooling is provided by a vapor compression system having an outdoor unit, the outdoor unit comprises a condenser to receive refrigerant vapor from a compressor of the vapor compression system and a cooling coil structurally independent of the condenser to receive a fluid from a heat transfer device operable to cool a component of the vapor compression system requiring cooling, and the fluid flows from the heat transfer device to the cooling coil, the fluid absorbing heat from the heat transfer device, and the fluid being cooled by airflow through the cooling coil.

2. An air-cooled condenser comprising:

a first coil circulating a first fluid;

a second coil independent from the first coil and circulating a second fluid, the second fluid being a liquid;

the first coil is adapted for connection to a compressor and receives the first fluid from the compressor; and the second coil is adapted for connection to a heat transfer device and receives the second fluid from the heat transfer device, the heat transfer device being operable to cool at least one of oil or electrical components.

3. The air-cooled condenser of claim 2 further comprising a fan to circulate air through the first coil and the second coil.

4. The air-cooled condenser of claim 3 wherein the second coil is positioned near the fan.

5. The air-cooled condenser of claim 4 wherein the second coil has a substantially vertical orientation to enable substantially horizontal airflow through the second coil.

6. The air-cooled condenser of claim 4 wherein the second coil has a substantially horizontal orientation to enable substantially vertical airflow through the second coil.

7. The air-cooled condenser of claim 3 wherein the second coil is positioned opposite to the fan.

8. The air-cooled condenser of claim 7 wherein the second coil has a substantially horizontal orientation to enable substantially vertical airflow through the second coil.

9. The air-cooled condenser of claim 7 wherein the first coil comprises a pair of first coils, the second coil comprises a pair of second coils, each second coil of the pair of second coils is structurally independent from the pair of first coils and is positioned below a corresponding first coil to form a coil slab, and the corresponding pair of coil slabs are positioned to form a V-shaped geometry.

10. An air-cooled condenser, comprising:

a plurality of sections, each section of the plurality of sections comprising a first coil circulating a first fluid and a fan to circulate air through the first coil;

one section of the plurality of sections being a first section comprising a second coil, the second coil being independent of the corresponding first coil and circulating a second fluid, and the corresponding fan of the section being positioned to circulate air through the second coil;

wherein the first coil being adapted for connection to a compressor and being configured to receive the first fluid from the compressor; and wherein the second coil being adapted for connection to a heat transfer device and being configured to receive the second fluid from the heat transfer device.

11. The air-cooled condenser of claim 10 wherein the second coil is structurally independent of the first coil.

12. The air-cooled condenser of claim 10 wherein another section of the plurality of sections different from the one section of the plurality of sections being a second section, the second section comprises a third coil, the third coil being independent of the corresponding first coil and being in fluid communication with the second coil.

13. The air-cooled condenser of claim 10 wherein the first coil of each section of the plurality of sections comprises a pair of coils, the pair of coils being positioned at an angle, and the second coil being positioned between the pair of coils.

14. The air-cooled condenser of claim 13 wherein the second coil has a substantially vertical orientation to enable substantially horizontal airflow through the second coil.

15. The air-cooled condenser of claim 10 wherein another section of the plurality of sections different from the one section of the plurality of sections is a second section, the second section comprises a third coil, the third coil being independent of the corresponding first coil and circulating a third fluid, the third coil being adapted for connection to a second heat transfer device and being configured to receive the third fluid from the second heat transfer device.

16. The air-cooled condenser of claim 13 wherein the second coil has a substantially horizontal orientation to enable substantially vertical airflow through the second coil.

17. An air-cooled condenser comprising:

a cabinet;

a condenser coil positioned in the cabinet, the condenser coil being part of a first circuit circulating a refrigerant fluid;

an auxiliary cooling coil structurally independent of the condenser coil, the auxiliary cooling coil being positioned in the cabinet and being part of a second circuit circulating a second fluid;

the second fluid being one of oil, water or water with an additive;

the condenser coil and the auxiliary cooling coil having independent inlets and outlets; and at least one fan positioned in the cabinet to circulate air through both the condenser coil and the auxiliary cooling coil.

18. The air-cooled condenser of claim 17 wherein the auxiliary cooling coil has a substantially horizontal orientation to enable substantially vertical airflow through the auxiliary cooling coil.

19. The air-cooled condenser of claim 17 wherein at least one of the condenser coil or the auxiliary cooling coil further comprise a multichannel coil.

20. The air-cooled condenser of claim 17 wherein the auxiliary cooling coil has a substantially vertical orientation to enable substantially horizontal airflow through the auxiliary cooling coil.

* * * * *

UNITED STATES PATENT AND TRADEMARK OFFICE

CERTIFICATE OF CORRECTION

PATENT NO. : 8,413,461 B2
APPLICATION NO. : 12/670276
DATED : April 9, 2013
INVENTOR(S) : Yanik et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 492 days.

Signed and Sealed this
Thirtieth Day of December, 2014

Michelle K. Lee

Michelle K. Lee
*Deputy Director of the United States Patent and Trademark Office*